US006619177B1

(12) United States Patent
Hansen et al.

(10) Patent No.: US 6,619,177 B1
(45) Date of Patent: Sep. 16, 2003

(54) DEVICE; ESPECIALLY FOR CLEARING OF LAND MINES

(75) Inventors: Tormod Hansen, Halden (NO); Dag Aspli, Tistedal (NO); Barry Middlemass, Surrey (GB)

(73) Assignee: Norwegian Demining Consortium AS, Tistedal (NO)

( * ) Notice: Subject to any disclaimer, the term of this patent is extended or adjusted under 35 U.S.C. 154(b) by 0 days.

(21) Appl. No.: 10/069,924

(22) PCT Filed: Aug. 29, 2000

(86) PCT No.: PCT/NO00/00281

§ 371 (c)(1),
(2), (4) Date: Jun. 13, 2002

(87) PCT Pub. No.: WO01/16549

PCT Pub. Date: Mar. 8, 2001

(30) Foreign Application Priority Data

Sep. 1, 1999 (NO) ..... 994232

(51) Int. Cl.[7] ..... F41H 11/16
(52) U.S. Cl. ..... 89/1.13; 89/1.11
(58) Field of Search ..... 89/1.13, 1.11

(56) References Cited

U.S. PATENT DOCUMENTS

| | | | | | |
|---|---|---|---|---|---|
| 2,425,357 | A | * | 8/1947 | Walker | 89/1.13 |
| 2,489,564 | A | * | 11/1949 | Du Toit | 89/1.13 |
| 2,496,423 | A | * | 2/1950 | Taylor | 89/1.13 |
| 4,765,221 | A | | 8/1988 | Sombrowski | |
| 4,987,819 | A | * | 1/1991 | Brown | 89/1.13 |
| 5,007,325 | A | * | 4/1991 | MacWatt | 89/1.13 |
| 6,148,926 | A | * | 11/2000 | Manor et al. | 172/45 |

FOREIGN PATENT DOCUMENTS

| | | | | |
|---|---|---|---|---|
| DE | 3127-856 | * | 2/1983 | 89/1.13 |
| EP | 0 640 808 | | 3/1995 | |
| GB | 2 126 958 | | 4/1984 | |
| GB | 2 170 158 A | * | 7/1986 | F41H/11/16 |
| WO | wo 93/11402 | | 6/1993 | |
| WO | WO 98/14748 | * | 4/1998 | F41H/11/16 |

* cited by examiner

*Primary Examiner*—Michael J. Carone
*Assistant Examiner*—Gabriel S Sukman
(74) *Attorney, Agent, or Firm*—Young & Thompson

(57) ABSTRACT

An apparatus, especially for clearing landmines, wherein there is arranged on a carrier machine (1) a flail unit (11) connected to an engine to power a flail rotor (12) equipped with chains and weights, which unit (11) comprises two flail arms (13) which at a first end support the flail rotor (12) and at a second end are made in the form of a frame (14), where the arms (13) are pivotally supported at a pivot point (17), so that when the flail rotor (12) is in operation the unit (11) will be maintained in a floating position relative to the surface of the terrain, which apparatus is equipped with a protective shield (15) between the flail rotor (12) and the carrier machine (1). The impacts of the chains and weights against the ground provide an uplift equal to the weight of the flail rotor (12), including the flail arms (13) up to the support point (17), and the protective shield (15) is arranged on the flail unit (11), preferably on the flail frame (14), so that it floats therewith and is thus capable of bending backwards when the unit (11) is raised or lowered as a consequence of, e.g., a detonation.

16 Claims, 5 Drawing Sheets

DEVICE; ESPECIALLY FOR CLEARING OF LAND MINES

BACKGROUND OF THE INVENTION

The invention relates to a modified construction machine for clearing all types of landmines and which with simple modifications is also suitable for clearing vegetation such as bushes and scrub in, e.g., mine-laid areas.

DESCRIPTION OF RELATED THE ART

During the Second World War special apparatus, so-called flail units, were developed for use in the work of mechanical mine clearance. A unit of this kind traditionally comprises a rotor or shaft secured between two fixed arms arranged on the front of a carrier machine. Chains with weights at the end thereof are secured to the rotor. The intention is that the mines are to be detonated or crushed when the rotor rotates and the chains and their weights beat the ground. The mines may be anything from anti-personnel mines of from about 200 g to anti-tank mines having a charge of up to several kilos of high explosive (HE). To be able to withstand the impact of the explosions, the first carrier machines were modified military tanks. More recently, other types of vehicles, for example, tractors and large construction machines, have been used as carrier machines for the flail unit. The traditional flail units are effective and practical in use. However, the operation of the unit calls for substantial engine power, especially when it is desirable to run the rotor at high speed and work deep in the ground. This, taken in conjunction with the fact that the carrier machine must be equipped with the necessary armour plating and personnel protection, means that the machines concerned are very powerful, bulky, heavy and of poor manoeuvrability.

One example of known apparatus for clearing mines where the flail unit is mounted on a civilian vehicle is the Danish machine Hydrema, a machine equipped with two engines and weighing about 16 tonnes. However, probably the most common of these vehicles today is the Aardwark J.S.F.U. Mk. III that is based on a large Ford tractor and weighs about 14 tonnes.

The main problem with the first flail units was that mines located in sunken parts of the terrain were not detonated by the flails that were designed to "sweep" at a constant height above ground level and did not follow the surface contour of the terrain. To eliminate this problem, a counterweight was apparently fastened on the rear end of the flail arm on the mine clearance apparatus Sherman Crab Mark II in order to ensure that the flail was "balanced" above a point. In this way, it was believed that it was possible to maintain the rotor arm and the chains at a constant height above ground level.

Another example of prior art is taught in U.S. Pat. No. 4,765,221, which describes a tank-like mine clearance apparatus equipped with a rotating flail arrangement. As further examples of traditional mine clearance apparatus, reference can be made to GB Patent Application 2 126 958 A, WO 93/11402 and U.S. Pat. No. 5,007,325 (Aardwark). The Aardwark machine apparently has a flail unit that "floats" at the desired height above the terrain because of the impacts of the flail chains against the ground, thereby ensuring greater effectiveness when the mines are buried. However, the protective shield is mounted on wheels in order to follow the surface of the ground, and the teaching of this document does not outline any Technical measures that will bring about an effect similar to that caused by the mine clearance apparatus according to the invention. This machine is thus in fact a conventional, large, powerful tractor or construction machine.

Lastly, mention may be made of another document, WO 07/46848, which describes a so-called miniflail. This appears to resemble the invention, but is used primarily as a scrub clearer, i.e., it "sweeps" anti-personnel mines and the like from the surface of the ground. The structural design suggests that it is unsuitable for use against powerful, possibly buried mines and/or explosive charges.

An article relating to a new mine clearing system, the so-called Compact 230 Minecat, was published in Jane's Defence Weekly on Jul. 21, 1999. The present invention is based on this system. Although the Minecat mine-clearing system has a number of advantages compared to the conventional flail apparatus, it does have a number of drawbacks or deficiencies. For example, the hydraulic system cannot be operated to cause the flail unit to "float" above and follow the terrain, thereby providing the necessary whipping force against the ground to ensure that mines in depressions, irregularities or the like in the terrain are detonated. Indeed, this was not the intention, and the machine functions basically as a scrub clearer. Consequently, it is not particularly suitable for handling explosives that are larger than so-called anti-personnel mines. Because of.the small size and the low weight of the Minecat clearance apparatus, it was necessary to shape and support the protective shield so as to ensure optimum deflection of the impact of powerful mine detonations, i.e., blast waves, splinters, earth, gravel etc. At the same time, it was necessary to ensure that the vehicle was not exposed to forces causing it to be lifted, overturned or in some other way brought out of its working position Moreover, it has been found that there is a need for a mine clearance apparatus which can also be used for removing vegetation such as bushes and scrub prior to the clearance of the landmines.

SUMMARY OF THE INVENTION

The deficiencies and drawbacks of the known mine clearance apparatus are eliminated according to the invention.

The mine clearance apparatus according to the invention weighs about 6.5 tonnes. It is small and compact, and relatively inexpensive to produce and maintain. It does not require any special transport system and lends itself well to transport by plane. Moreover, it can be airlifted by a CH-47 Chinook helicopter. It is also suitable for transport by truck or trailer and can, for example, be driven into a standard ISO container for shipment by sea or rail.

BRIEF DESCRIPTION OF THE DRAWINGS

The invention will now be described with reference to the drawings wherein.

DESCRIPTION OF THE PREFERRED EMBODIMENTS

Figure 1:
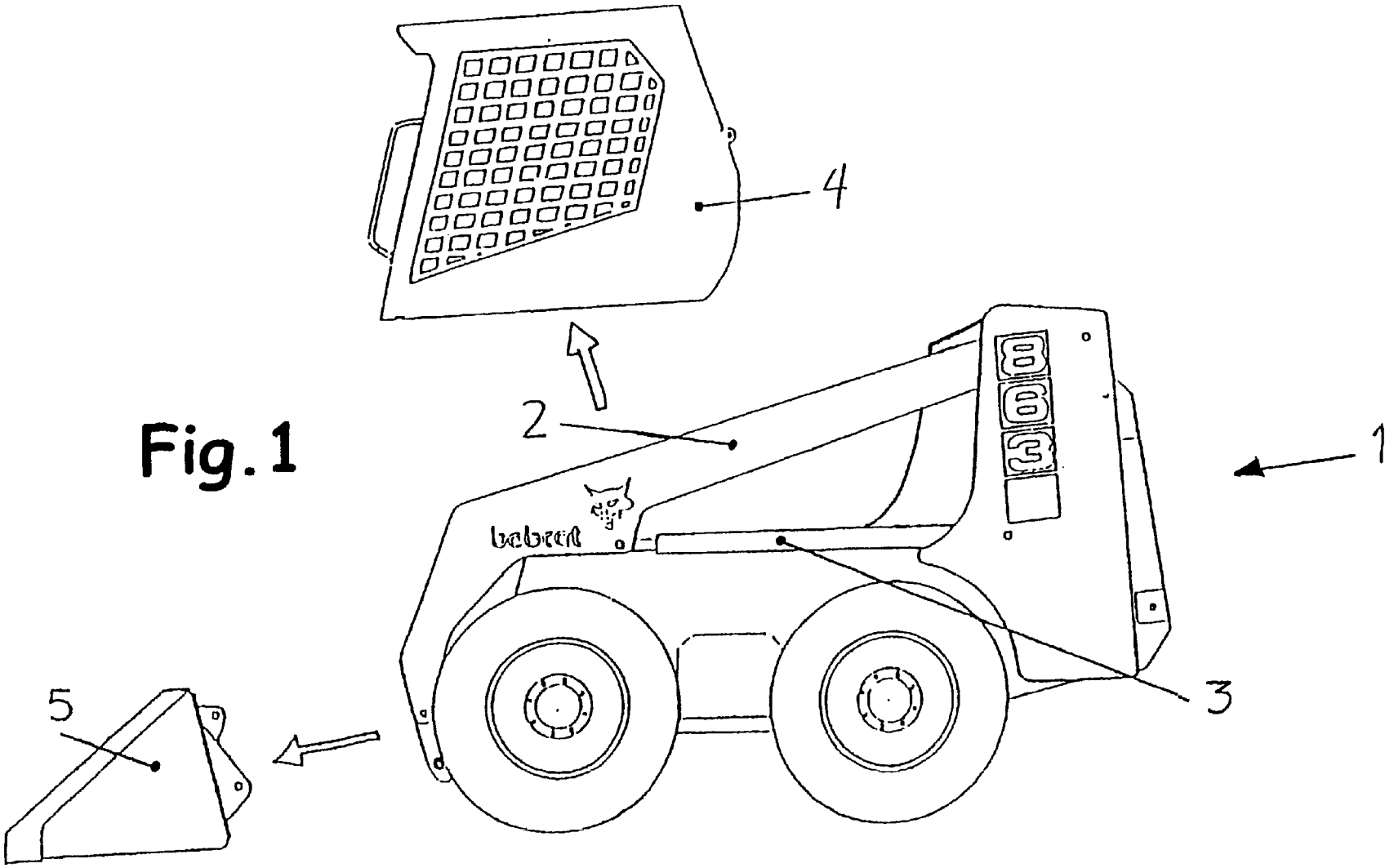
FIG. 1 is a schematic illustration of a construction machine of the Bobcat type with the operator's cab and loading bucket separated from the machine.
Figure 2:
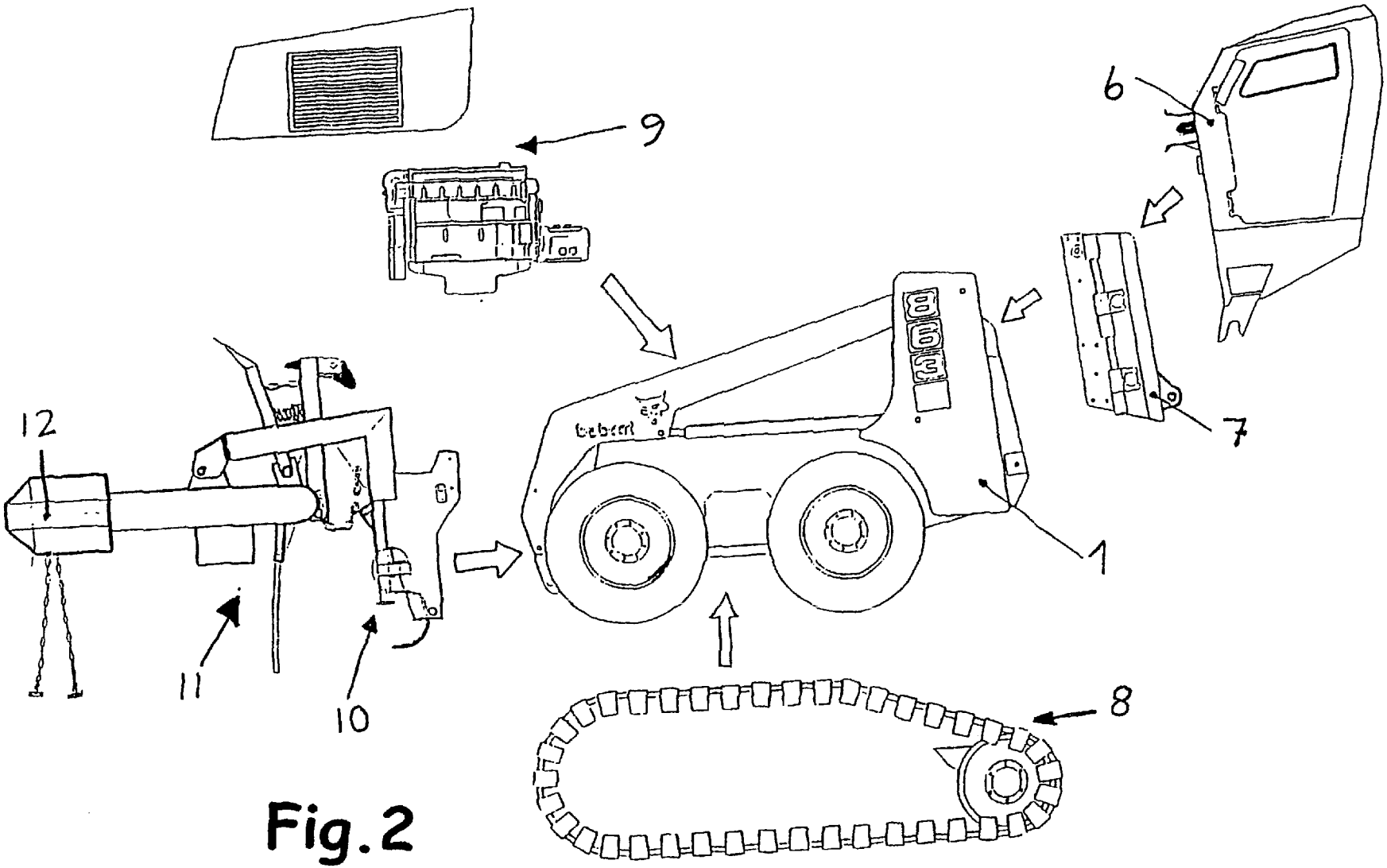
FIG. 2 is a schematic illustration of the construction or carrier machine with extra equipment for arrangement thereon in order to provide a mine clearance apparatus according to the invention.

FIG. 1 shows a carrier machine 1, which, e.g., may be a construction machine of the Bobcat type equipped with implement or tool arms 2 that are operated by hydraulic cylinders 3. The figure also shows a loading bucket 5 and an operator's cab 4 detached from the machine 1. FIG. 2 is a schematic illustration of how the carrier machine 1 in FIG. 1 is modified to provide a mine clearance machine. In the drawing, the reference numeral 6 indicates an armoured, safety cab. This may be equipped with an air conditioning plant and may also include devices and arrangements for remote control of the carrier machine and ancillary equipment. The cab 6 is mounted on the machine 1 with the aid of suitable rapid coupling or adapter 7 in such a way that it can be easily removed from the machine without any external assistance. The adapter 7 may also be used for securing working implements such as, for instance, various agricultural attachments. As outlined, steel or rubber crawler tracks and stabilising extra wheels 8 are also provided. The reference numeral 9 indicates an extra engine with hydraulic pump and cover. This engine is only intended to power a flail rotor. The regular propulsion engine of the construction machine can therefore be maintained in an unmodified form. The reference numeral 10 indicates schematically a fastening device for the flail unit.

Figure 3:
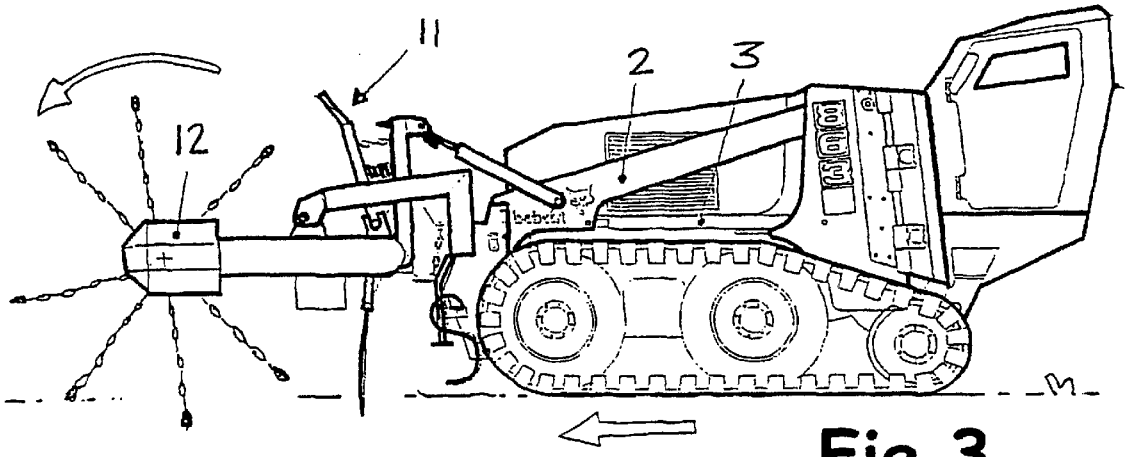
FIG. 3 is a schematic illustration of a first embodiment of the apparatus according the invention.
Figure 4:
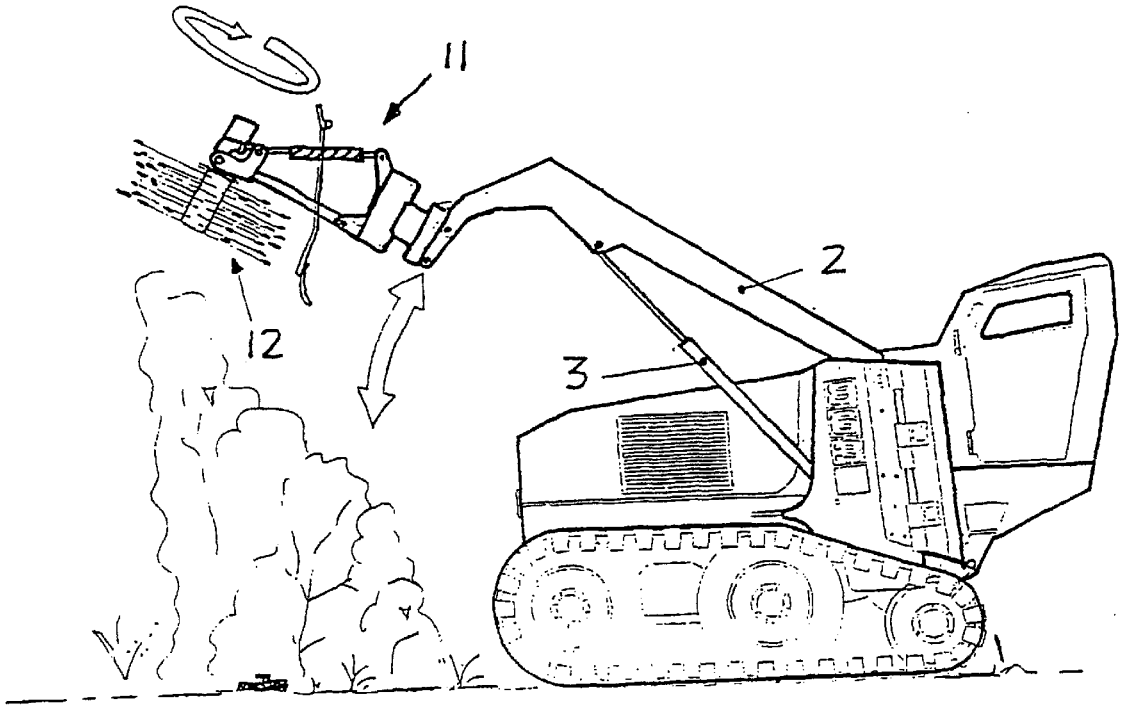
FIG. 4 is a schematic illustration of a second embodiment of the apparatus according to the invention.

FIGS. 3 and 4 show the mine clearance apparatus according to the invention with two respective types of flail unit 11. The flail rotor is indicated by means of the reference numeral 12 and is equipped in the usual manner with chains preferably having weights attached thereto, as can be seen more clearly from FIGS. 6 and 7.

Figure 5A:
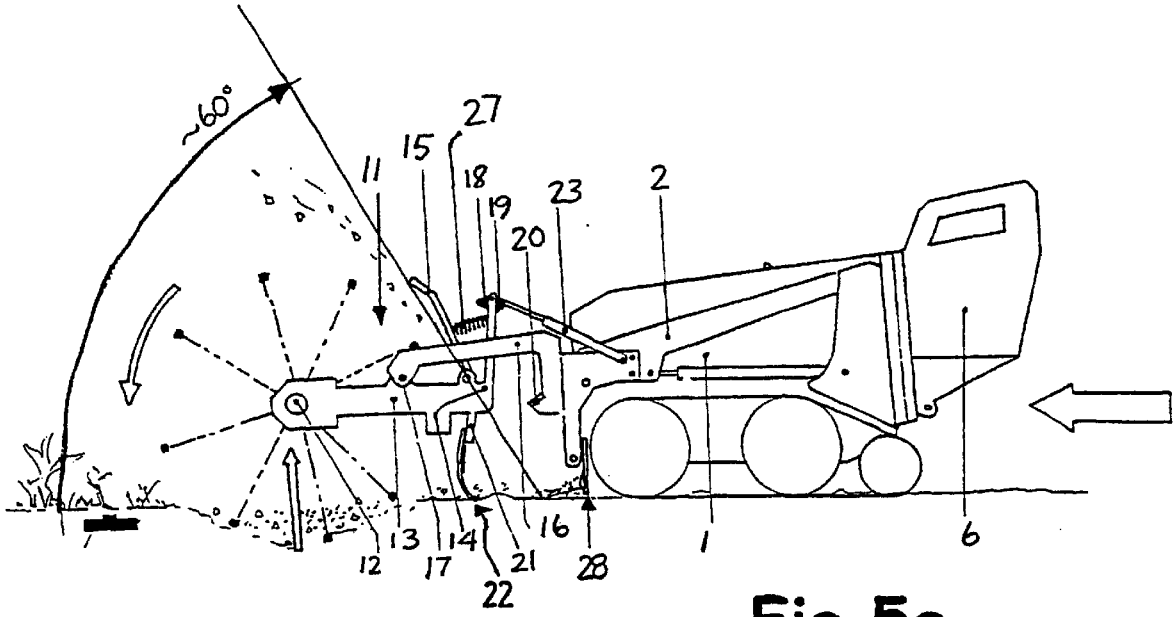
FIG. 5A is a schematic illustration of details of the flail unit with the protective shield mounted on the embodiment of the invention shown in FIG. 3 during forward travel while clearing mines.

FIG. 5A shows the fundamental principles of the arrangement of the flail unit with protective shield in the first embodiment of the invention. The flail unit 11 comprising the flail rotor 12 is arranged between two flail arms 13 at a first end thereof The second end of the arms 13 passes into a flail frame 14 that runs at a suitable angle relative to the plane of the arms 13. In the drawing, the plane of the frame is shown almost perpendicular to the plane of the arms. There are also provided support arms 16 which at one end pivotally support a pivot point 17 on the flail arms. This pivot point 17 may be arranged to be displaceable or adjustable in that, e.g., a displaceable clamp means (not shown) is provided. The fastening device 10 for securing the unit 11 to the tool arms 2 of the machine is arranged on the opposite end of the arms 16. In the front of the flail frame there is provided a protective shield 15, preferably positioned at an angle so that it inclines forward as indicated in, for example, FIG. 3. At the upper end thereof, the shield 15 may be designed to have a suitably curved portion in order to enhance its shielding effect. The shield 15 is preferably pivotally supported and maintained under tension by a suitable force, e.g., by a spring or springs provided for this purpose and indicated by means of the reference numeral 27 in FIG. 5A. At its lower end, the protective shield 15 passes into a further shield portion 21 which may be equipped with a skirt 22, e.g., of a suitable, preferably splinter-proof, rubber material. The flail frame 14 is equipped with buffers 18 and 19 for respectively the protective shield 15 and the impact of the actual frame against a buffer point 20 on the fastening device 10. The flail frame cylinders 23 are supported by means of a suitable fitting on the tool arms 2 and on the flail frame 14. These cylinders 23 can be operated to raise or lower the flail unit as required.

The mode of operation of the flail unit is as follows: During the clearing of mines the frame cylinders are set in a substantially "free" floating position, i.e., they do not exert any force on the flail frame 14. Because of the weight of the unit and the position of the pivot point 17, the flail rotor 12 with its chains and weights will exert a downward force. With the aid of a hydraulic pump and associated lines, and a suitable driving unit, or another appropriate drive system, the engine 9 causes the flails, i.e., the rotor 12 with its chains and weights, to rotate so that the impact force of the flails against the ground cancels out the downward force. When the machine is driven over the field to be cleared, the unit will thus float above the ground and the flails will follow all irregularities and depressions in the terrain. A suitable speed of rotation may be in the range of 300–350 rpm, but it is obvious that the speed of rotation, the flail dimensions and the positioning of the pivot point 17 should all be chosen to ensure that the impact force against the ground is optimised with a view to detonating the mines For the mine clearance apparatus to work as intended, it is crucial that the "free" floating of the unit with the right impact force against the ground is assured. Because of the comparatively short flail arms 13, the flail rotor 12 may in some situations be in a position that is too high relative to the surface of the ground during the clearing of mines. This may happen, e.g., when one or both of the crawler tracks in the front of the vehicle roll against and over an elevation in the ground. The elevation may be a naturally occurring irregularity or it may, e.g., be due to an accumulation of soil/gravel or the like when the forward motion of the vehicle has came to a stop whilst the flail rotor continues to rotate and "pound up" the ground. Normally, the operator must then reverse the vehicle and repeat the clearing operation across the area where the flail may have been too high. To eliminate this problem, clearance blades may be provided, indicated by means of the reference numeral 28 in FIG. 5A, in front of the tracks. These blades are given an appropriate shape, for instance, a share or plough shape, and are secured in a suitable manner to the tool arms 2 or another suitable point so that they lie in front of the tracks at a suitable height above the ground, and thus ensure the desired levelling or clearing of accumulations of soil etc. Arrangements for warning the operator, for instance in connection with slightly larger obstacles, may also be provided. An example of both height above the ground and distance in front of the tracks is 4–5 cm, but these values can of course be adjusted and chosen according to what is considered to be suitable.

Figure 5B:
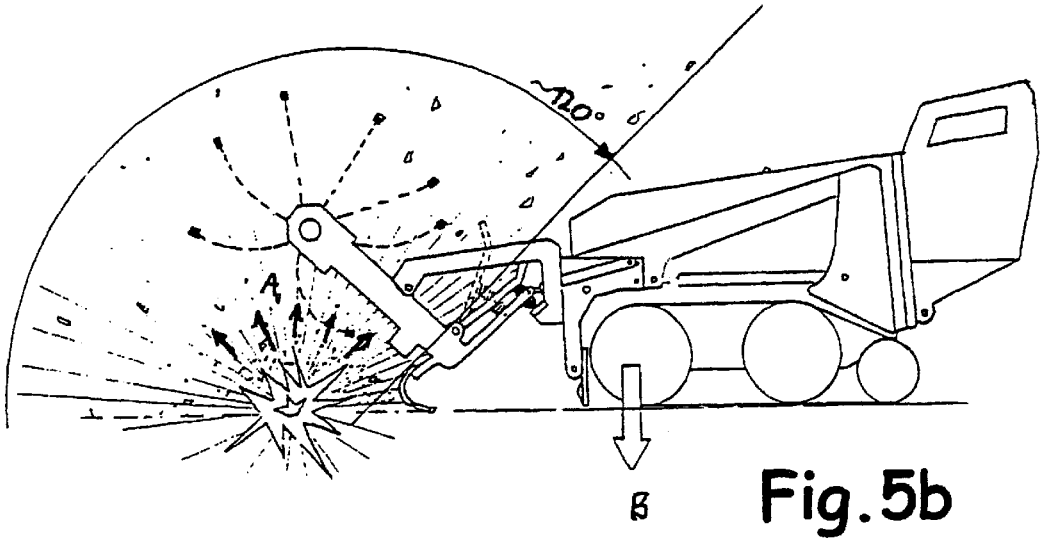
FIG. 5B illustrates schematically how the mine clearance apparatus in FIG. 3 behaves during the detonation of a mine.

FIG. 5B illustrates a detonation. The arrows A indicate the "forces" that are released on detonation, i.e., blast waves, splinters, earth and gravel etc. The flail rotor 12 will be lifted upwards as the arms 13 are rotated about the centre of support or pivot point 17. Because of the detonation effect, the flail frame 14 with the buffers 19 will strike the buffer point 20 on the flail frame 14. The protective shield 15 will be forced against the action of the aforementioned spring or springs 27, or similar means, be so that it strikes the shield buffers 18. FIG. 5A indicates that during ordinary forward movement the arms 13 will float approximately horizontally and the angle of the plane of the protective shield 15 that extends from its upper end to its point of support on the frame 14 will be about 60° relative to the arm plane. Since it is freely floating, the unit 11 will be lifted and rotated together with the protective shield 15 during detonation, so that the said angle will be about 120°, as indicated in FIG. 5B. The springs 27 of the shield 15 will be compressed and this, in conjunction with the effect of the buffers, will cushion the shock effect. Because the shield 15 is bent or pressed backwards whilst absorbing the detonation force, a substantial part of the force will be transmitted to the machine as a downward force as indicated by the arrow B.

Thus, the machine, instead of being lifted as a consequence of the detonation, assumes a more stable position as it will be pressed down and fixed to the ground so that it remains stable and steady.

Figure 7:
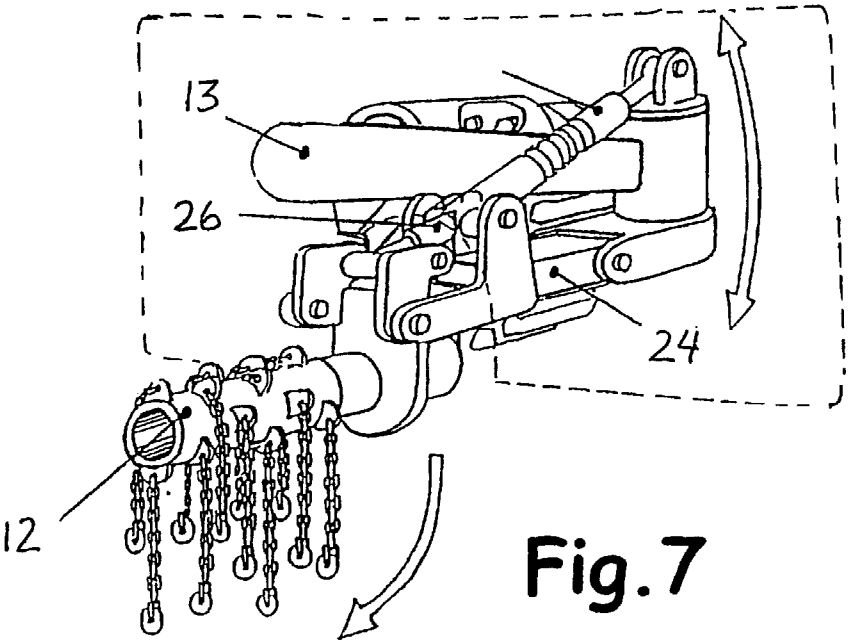
FIGS. 6–7 are schematic illustrations of details of the flail unit in the embodiment shown in FIG. 4.
Figure 8:
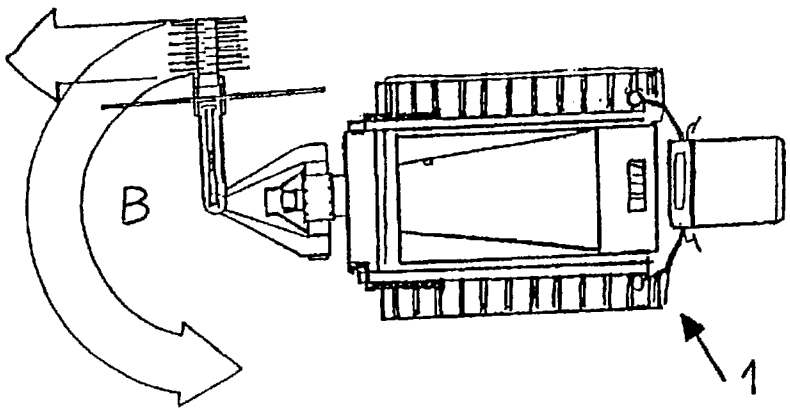
FIG. 8 is a schematic illustration of the apparatus in FIG. 4 while making "oscillating" progress.
Figure 6:
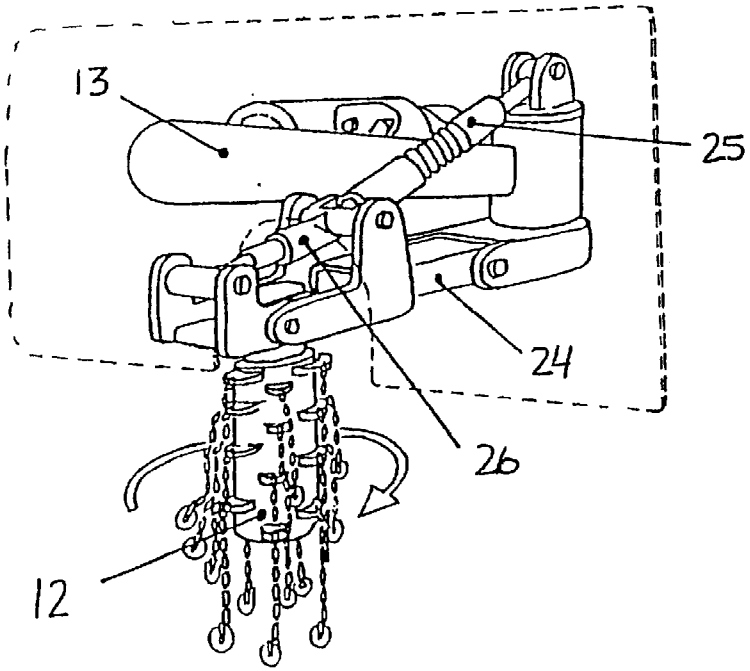

FIGS. 6–8 show details of the embodiment of the apparatus in FIG. 4. In these figures, the flail unit 11 is slightly modified in relation to the first embodiment of the special arrangement of the flail rotor 12. Here, the protective shield has a traditional role, is made in the form of a plate-like body and is only indicated in broken lines in FIGS. 6 and 7. The unit 11 is supported in a suitable manner on the tool arms 2 of the carrier machine. The flail rotor 12 is powered by an extra engine 9 with associated hydraulic system. As shown in FIGS. 6 and 7, the unit 11 is equipped with flail arms 13, a pendulum arm 24, shock absorber 25 and tilt cylinder 26.

The embodiment is particularly suitable for removing vegetation such as dense brush and scrub which is often found on minefields and which may present a problem. The flail rotor 12 is preferably made comparatively short and there are fewer chains mounted thereon than in the first embodiment. This renders the equipment less power-consuming and the speed of rotation can be increased to, e.g., about 2700 rpm., which may be required for the removal of vegetation. As can be seen from FIG. 4, the flail unit may be lifted relatively high, thereby making it possible to cut bushes and scrub by starting at the top and moving gradually downwards. In use, with the aid of the pendulum arm, the unit 11 is made to oscillate or sweep across an angle of at least 180° as indicated by the arrow B in FIG. 8. This may be controlled either automatically or manually. After one or, if necessary, more sweeping movements, the carrier machine is made to advance a short distance before a new sweep and so on, until the whole field has been cleared.

The rotor 12 can also be tilted continuously with the aid of a hydraulic tilt cylinder 26 until it reaches a completely vertical position. A vertical position of this kind can further increase the efficiency of the removal of bushes and scrub. The pendulum flail unit 11 can also be locked in a position at right angles to the carrier machine, which may be advantageous when flailing along fences or house walls. The height of the rotor 12, when in a horizontal position relative to the ground, should be constant. This can be ensured by mounting a sensor on the hydraulic system of the machine to detect whether the rotor 12 is working with force, i.e., deep down, or with ease, i.e., high up. The position can thus be adjusted automatically by means of suitable electronic equipment.

Once a geographic area has been cleared of mines, the machine can, if so desired, be remodified for civilian use.

What is claimed is:

1. An apparatus for clearing landmines, wherein there is arranged on a carrier machine (1) a flail unit (11) connected to an engine to power a flail rotor (12) equipped with chains and weights, which unit (11) comprises two flail arms (13) which at a first end support the flail rotor (12) and at a second end are made in the form of a frame (14), where the arms (13) are pivotally supported at a pivot point (17), so that when the flail rotor (12) is in operation, the unit (11) will be maintained in a floating position relative to the surface of the terrain, which apparatus is equipped with a protective shield (15) between the flail rotor (12) and the carrier machine (1), characterised in that the impacts of the chains and weights against the ground provide an uplift equal to the weight of the flail rotor (12) including the flail arms (13) up to the pivot point (17), and the protective shield (15) is arranged on the flail unit (11) so that it floats therewith and is thus capable of bending backwards when the unit (11) is raised or lowered as a consequence of a detonation of a mine.

2. An apparatus according to claim 1, characterised in that the machine chassis is furnished with armour plating and the machine (1) is equipped with a detachable, armoured operator's cab (6), and the flail arms (13) at the pivot point (17) are connected to two support arms (16) which by means of a fastening device are joined to the tool arms (2) of the machine in such manner that the flail unit (11) is removable and may be replaced by other attachments if desired.

3. An apparatus according to claim 1, characterised in that at its upper end the shield (15) is shaped having a curved portion and at its other end it passes into a lower part or shield portion (21) which is equipped with a skirt (22) of a suitable material.

4. An apparatus according to claim 1, characterised in that there is arranged a sensing device to monitor the load and thus the height of the flail rotor (12), and suitable adjusting means for the flail arm so that the rotor (12) can be held at the desired height above the ground.

5. An apparatus according to claim 1, characterised in that the operator's cab (6) is mounted at the rear edge of the carrier machine (1) with the aid of a rapid coupling (7) in such manner and so equipped that it can be detached from the machine (1) without any external assistance, and that the cab (6) is equipped with armoured glass and that its bottom part is V-shaped.

6. An apparatus according to claim 1, characterised in that there are provided means to permit the machine (1) and attachments to be remote-controlled from the detached operator's cab (6) or from another suitable site within the range of vision.

7. An apparatus according to claim 1, characterised in that in the front of the crawler tracks (8) there are provided clearance blades (28) at a suitable distance above the ground and in front of the tracks, secured to the tool arms (2) or another suitable point, so that small irregularities or elevations in the surface of the ground are levelled or cleared as the machine (1) moves forward.

8. The apparatus of claim 1, wherein the protective shield is arranged on the flail frame (14).

9. The apparatus of claim 1, wherein the shield (15) is arranged at an angle so as to incline forward, and is pivotally supported and held under tension by one or more springs (27).

10. An apparatus according to claim 9, characterised in that the one or more springs (27) are arranged on the flail frame (14) which is also equipped with buffers (18, 19) in order, in the event of a mine detonation, to cushion the impact of the protective shield (15) against the frame (14) and the impact of the frame (14) against a buffer point (20) on the fastening device for the support arms (16).

11. An apparatus for clearing landmines, wherein a carrier machine (1) has been modified in that wheels and crawler tracks (8) have been mounted thereon, and that there is provided a flail unit (11) having an engine (9) to power the unit's flail rotor (12) which is equipped with chains and weights, wherein the machine chassis is furnished with amour plating and the machine (1) is equipped with a detachable, armoured operator's cab (6), characterised in that the flail unit (11) is made with the flail rotor (12) arranged on a support means comprising a pendulum arm (24), including a shock absorber (25) and a tilt cylinder (26), so that the rotor (12), can be set in a chosen orientation relative to the surface of the ground, and the operator's cab (6) is mounted at the rear edge of the carrier machine (1) with the aid of a rapid coupling (7) in such manner and so equipped that it can be detached from the machine (1) without any external assistance, and that the cab (6) is equipped with armoured glass and that its bottom part is V-shaped.

12. An apparatus according to claim 11, characterised in that the pendulum arm (24) can be operated, either automatically or manually, to sweep the rotor (12) across an area covering an angle of at least 180°.

13. An apparatus according to claim 11, characterised in that there is arranged a sensing device to monitor the load and thus the height of the flail rotor (12), and suitable adjusting means for the flail arm so that the rotor (12) can be held at the desired height above the ground.

14. An apparatus according to claim 11, characterised in that there are provided means to permit the machine (1) and attachments to be remote-controlled from the detached operator's cab (6) or from another suitable site within the range of vision.

15. An apparatus according to claim 11, characterised in that in the front of the crawler tracks (8) there are provided clearance blades (28) at a suitable distance above the ground and in front of the tracks, secured to the tool arms (2) or another suitable point, so that small irregularities or elevations in the surface of the ground are levelled or cleared as the machine (1) moves forward.

16. The apparatus of claim 15, further comprising arrangements to enable the clearance blades (28) to provide a warning to a machine operator.

* * * * *